US010336078B2

(12) United States Patent
Furukawa et al.

(10) Patent No.: US 10,336,078 B2
(45) Date of Patent: Jul. 2, 2019

(54) RECORDING HEAD AND INKJET RECORDING APPARATUS INCLUDING SAME

(71) Applicant: KYOCERA Document Solutions Inc., Osaka (JP)

(72) Inventors: Noriaki Furukawa, Osaka (JP); Takashi Somete, Osaka (JP); Masanobu Maeshima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/029,252

(22) Filed: Jul. 6, 2018

(65) Prior Publication Data

US 2019/0016140 A1 Jan. 17, 2019

(30) Foreign Application Priority Data

Jul. 11, 2017 (JP) ..... 2017-135686

(51) Int. Cl.
*B41J 2/165* (2006.01)

(52) U.S. Cl.
CPC ..... *B41J 2/16535* (2013.01); *B41J 2/16508* (2013.01); *B41J 2/16511* (2013.01); *B41J 2/16538* (2013.01); *B41J 2/16544* (2013.01); *B41J 2/16552* (2013.01); *B41J 2/16585* (2013.01)

(58) Field of Classification Search
CPC ..... B41J 2/16535; B41J 2/16585; B41J 2/16508; B41J 2/16538; B41J 2/16511; B41J 2/16544; B41J 2/16552
See application file for complete search history.

(56) References Cited

U.S. PATENT DOCUMENTS

2002/0171705 A1* 11/2002 Rhoads ..... B41J 2/16538 347/28

FOREIGN PATENT DOCUMENTS

JP 2007-83496 A 4/2007

* cited by examiner

*Primary Examiner* — Bradley W Thies
(74) *Attorney, Agent, or Firm* — Stein IP, LLC

(57) ABSTRACT

A recording head of the present disclosure includes an ink ejection surface where a plurality of ink ejection ports for ejecting ink onto a recording medium are disposed. A plurality of cleaning liquid supply ports for supplying a cleaning liquid are disposed on an upstream side with respect to the ink ejection ports in a wiping direction which is a direction in which a wiper wipes the ink ejection surface. The plurality of cleaning liquid supply ports each have a chamfer portion formed at a portion thereof that intersects a surface to be wiped by the wiper, the chamfer portion being R-shaped in section.

7 Claims, 11 Drawing Sheets

RECORDING HEAD AND INKJET RECORDING APPARATUS INCLUDING SAME

INCORPORATION BY REFERENCE

This application is based upon and claims the benefit of priority from the corresponding Japanese Patent Application No. 2017-135686 filed on Jul. 11, 2017, the entire contents of which are incorporated herein by reference.

BACKGROUND

The present disclosure relates to a recording head having an ink ejection port for ejecting ink onto a recording medium such as a sheet, and also relates to an inkjet recording apparatus including the same.

An inkjet recording apparatus that ejects ink to form an image is capable of forming a high-definition image and thus is widely used as a recording apparatus such as a facsimile, a copy machine, or a printer.

In such an inkjet recording apparatus, minute ink droplets (hereinafter, referred to as a mist) ejected together with ink droplets for image recording and a rebounded mist generated upon adhesion of the ink droplets to a recording medium adhere to, and solidify on, an ink ejection surface of a recording head. When the mist on the ink ejection surface gradually increases to form a pile in the ink ejection port, it may cause degradation of the linearity of ink ejection (trajectory deflection), failure of ink ejection, and so on, resulting in degraded printing performance of the recording head.

To solve this problem by cleaning an ink ejection surface of a recording head, a known inkjet recording apparatus is provided with a plurality of cleaning liquid supply ports disposed at a portion of the ink ejection surface on an outer side (an upstream side in a wiping direction of a wiper) of an ink ejection region where a plurality of ink ejection ports are disposed. In this inkjet recording apparatus, after a cleaning liquid is supplied through the cleaning liquid supply ports, the wiper is caused to move from an outer side beyond the cleaning liquid supply ports along the ink ejection surface, so that the wiper can wipe the ink ejection surface while retaining the cleaning liquid. In this manner, a recovery process for the recording head can be performed.

SUMMARY

According to a first aspect of the present disclosure, a recording head is one that includes an ink ejection surface where a plurality of ink ejection ports for ejecting ink onto a recording medium are disposed. A plurality of cleaning liquid supply ports for supplying a cleaning liquid are provided on an upstream side with respect to the ink ejection ports in a wiping direction which is a direction in which a wiper wipes the ink ejection surface. The cleaning liquid supply ports each have a chamfer portion formed at a portion thereof that intersects a surface to be wiped by the wiper, the chamfer portion being R-shaped in section.

Still other objects of the present disclosure and specific advantages provided by the present disclosure will become further apparent from the following description of embodiments.

DETAILED DESCRIPTION

Hereinafter, embodiments of the present disclosure will be described with reference to the accompanying drawings.

Figure 1:
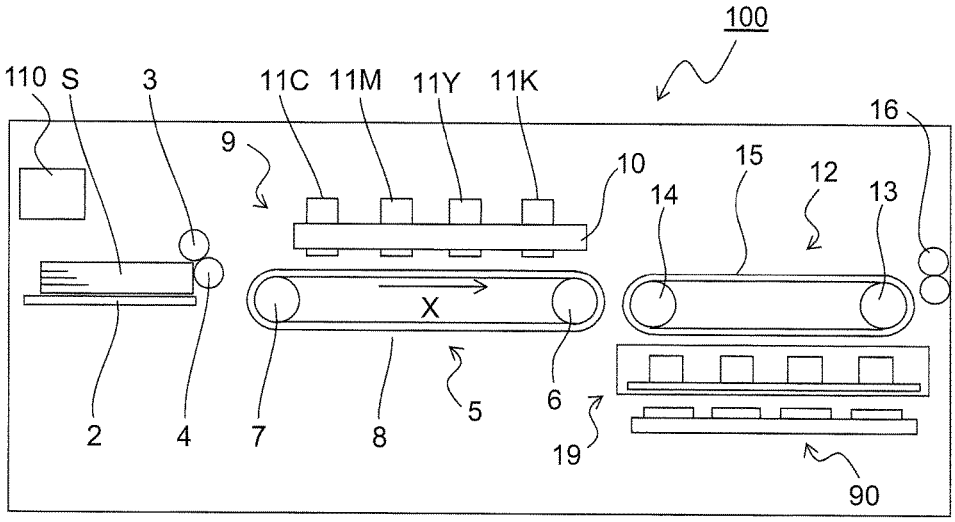
FIG. 1 is a diagram illustrating a structure of an inkjet recording apparatus including a recording head according to a first embodiment of the present disclosure.

First Embodiment: As illustrated in FIG. 1, in a left side portion of an inkjet recording apparatus 100 according to a first embodiment of the present disclosure, a sheet feeding tray 2 is disposed in which sheets S (recording media) are stored, and at one end portion of the sheet feeding tray 2, there are disposed a sheet feeding roller 3 for conveying the sheets S stored in the sheet feeding tray 2 one by one sequentially from an uppermost one thereof to a first conveyance unit 5, which will be described later, and a driven roller 4 which is in pressure contact with the sheet feeding roller 3 and rotates following rotation of the sheet feeding roller 3.

On a downstream side (a right side in FIG. 1) of the sheet feeding roller 3 and the driven roller 4 with respect to a sheet conveyance direction (an arrow X direction), the first conveyance unit 5 and a recording portion 9 are disposed. The first conveyance unit 5 includes a first driving roller 6, a first driven roller 7, and a first conveyance belt 8 which is wound around the first driving roller 6 and the first driven roller 7, and, based on a control signal from a control portion 110 of the inkjet recording apparatus 100, the first driving roller 6 is driven to rotate in a clockwise direction, whereby a sheet S held on the first conveyance belt 8 is conveyed in an arrow X direction.

Figure 2:
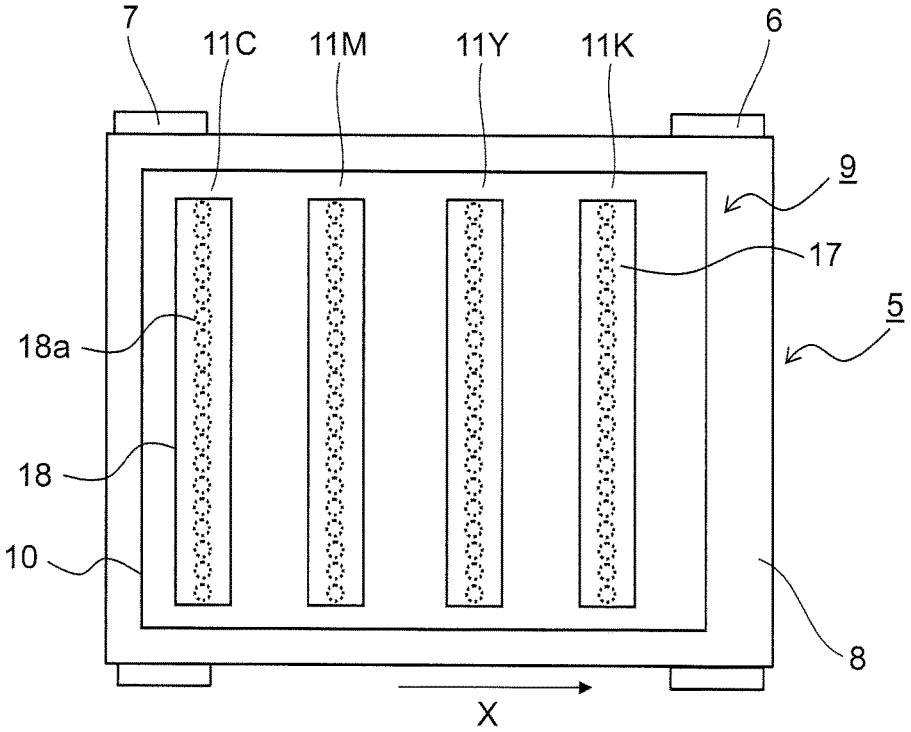
FIG. 2 is a diagram illustrating, as seen from above, a first conveyance unit and a recording portion of the inkjet recording apparatus illustrated in FIG. 1.

The recording portion 9 includes a head housing 10 and line heads 11C, 11M, 11Y, and 11K held in the head housing 10. These line heads 11C to 11K are supported at a height where a predetermined interval (for example, 1 mm) is formed with respect to a conveyance surface of the first conveyance belt 8, and as illustrated in FIG. 2, each constituted of one or more recording heads 17 (here, one recording head 17) extending along a sheet width direction (an up-down direction in FIG. 2), which is perpendicular to the sheet conveyance direction.

Figure 3:
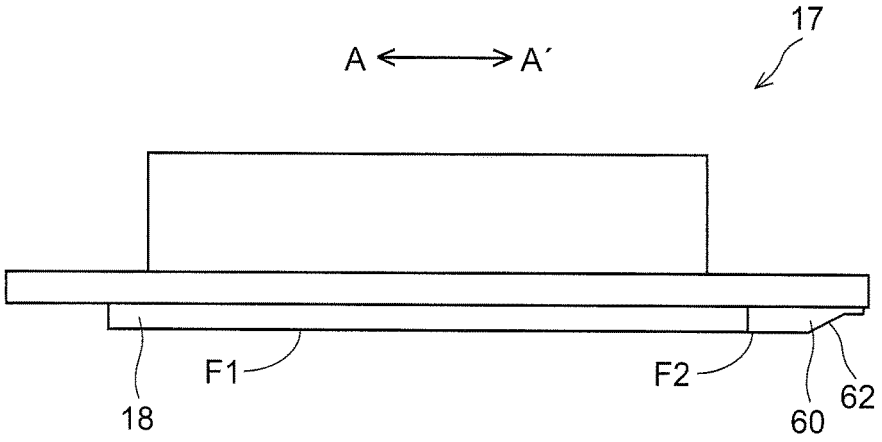
FIG. 3 is a diagram illustrating a recording head constituting a line head of the recording portion.
Figure 4:
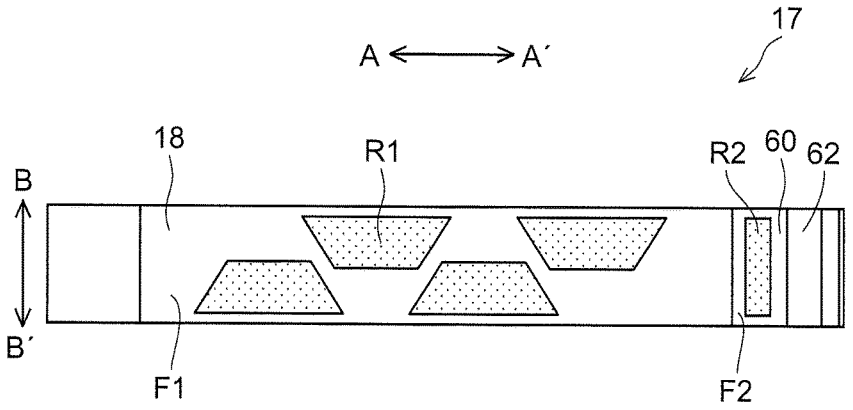
FIG. 4 is a diagram illustrating the recording head as seen from the ink-ejection-surface side.

As illustrated in FIG. 3 and FIG. 4, on an ink ejection surface F1 of a head portion (an ink ejection head portion) 18 of the recording head 17, there is provided an ink ejection region R1 where a large number of ink ejection ports 18*a* (see FIG. 2) are arranged.

To the recording head 17 constituting each of the line heads 11C to 11K, one of four color (cyan, magenta, yellow, and black) inks each stored in an ink tank (not shown) is supplied corresponding to the color of each of the line heads 11C to 11K.

Based on a control signal from the control portion 11C (see FIG. 1), each of the recording heads 17, in accordance with image data received from an external computer, ejects ink through the ink ejection ports 18*a* toward the sheet S, which is conveyed while being sucked and held on the conveyance surface of the first conveyance belt 8. Thereby, on the sheet S held on the first conveyance belt 8, images of respective inks of the four colors of cyan, magenta, yellow and black are superimposed one on another to form a color image.

Furthermore, the recording head 17 is provided with a cleaning liquid supply member (a cleaning liquid supply head portion) 60 for supplying a cleaning liquid. The cleaning liquid supply member 60 is disposed adjacent to an upstream side (a right side in FIG. 3) with respect to a head portion 18 in a wiping direction of a wiper 35, which will be described later. The cleaning liquid supply member 60 has a cleaning liquid supply surface (a surface for the wiper 35 to wipe) F2 which includes a cleaning liquid supply region R2 where a large number of (for example, several hundreds of) cleaning liquid supply ports 60*a* (see FIG. 5) are arranged for supplying the cleaning liquid. Here, in the head portion 18, at least the ink ejection surface F1 is formed of stainless steel (SUS), for example, and the cleaning liquid supply surface F2 of the cleaning liquid supply member 60 is formed of a polyimide resin, for example.

The cleaning liquid supply surface F2 is formed to be flush with the ink ejection surface F1. Furthermore, in a portion of the cleaning liquid supply member 60 on an upstream side (the right side in FIG. 3) with respect to the cleaning liquid supply surface F2 in the wiping direction, there is formed an inclined surface 62.

The cleaning liquid, which is preferably a solution containing a component similar to ink, is a liquid composition of which main components are a solvent component and water, and to which a surfactant, an antiseptic and antifungal agent, etc. are added as necessary.

Figure 5:
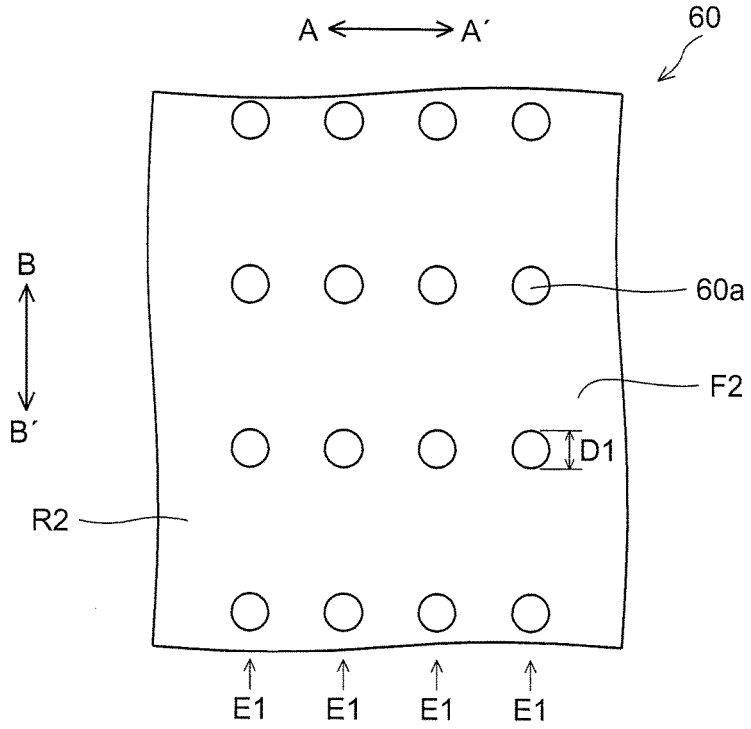
FIG. 5 is a diagram illustrating, as seen from below, cleaning liquid supply ports formed in a cleaning liquid supply member of the recording head.
Figure 6:
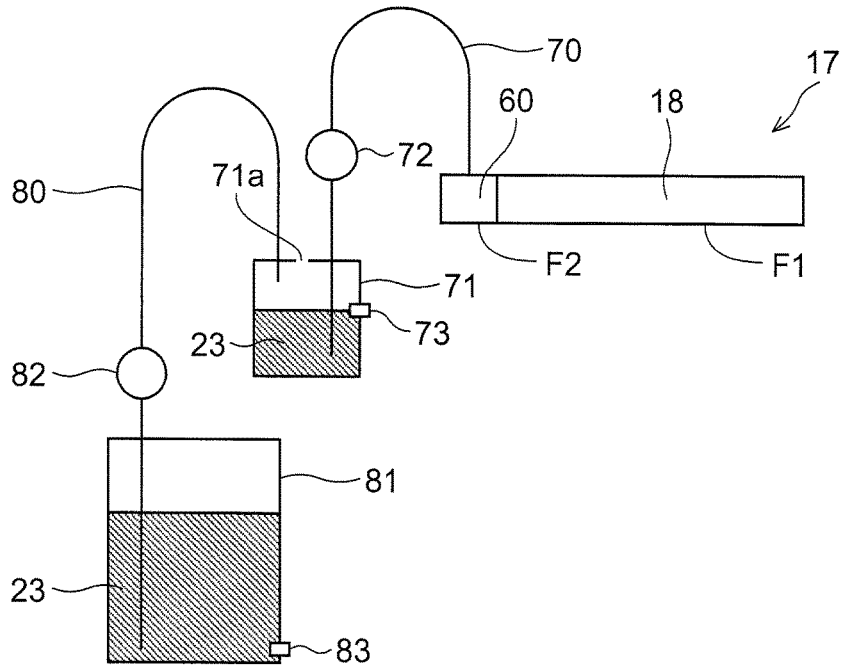
FIG. 6 is a diagram illustrating a configuration of and around the recording head, a subtank, and a main tank.

As illustrated in FIG. 6, to a cleaning liquid supply port 60*a* (see FIG. 5) of the cleaning liquid supply member 60, there is connected a downstream end of a cleaning liquid supply passage 70 which is formed of a tube through which a cleaning liquid 23 flows. An upstream end of the cleaning liquid supply passage 70 is connected to a subtank 71 which stores the cleaning liquid 23 to be supplied to the cleaning liquid supply member 60. The upstream end of the cleaning liquid supply passage 70 is placed in the cleaning liquid 23. The cleaning liquid supply passage 70 is provided with a supply pump 72 which pumps up the cleaning liquid 23 from the subtank 71 to send it to the cleaning liquid supply member 60. In the figure, the cleaning liquid 23 is hatched for easier understanding.

Furthermore, to the subtank 71, there is connected a downstream end of a cleaning liquid replenishment passage 80, which is formed of a tube through which the cleaning liquid 23 flows. An upstream end of the cleaning liquid replenishment passage 80 is connected to a main tank 81 which stores the cleaning liquid 23 to be replenished to subtank 71. The upstream end of the cleaning liquid replenishment passage 80 is placed in the cleaning liquid 23. The cleaning liquid replenishment passage 80 is provided with a replenishment pump 82 which pumps up the cleaning liquid 23 from the main tank 81 to send it to the subtank 71. As the supply pump 72 and the replenishment pump 82, a tube pump, a syringe pump, a diaphragm pump, etc. can be used, for example. Here, the supply pump 72 is configured to be switchable, when the supply is stopped, between a state in which communication between an inlet and an outlet of the supply pump 72 is closed and a state in which the communication is opened. As to a detailed structure of and around the cleaning liquid supply member 60, the subtank 71, and the main tank 81, descriptions will be given later.

In this inkjet recording apparatus 100, in each of the recording heads 17, in order to clean the ink ejection surface F1, at a start of printing after a long-term shutdown and during an interim between printing operations, ink is forcibly discharged through the ink ejection ports 18*a*, and simultaneously, the cleaning liquid 23 is supplied to the cleaning supply surface F2 through the cleaning liquid supply ports 60*a* (see FIG. 5), and then, the ink ejection surface F1 is wiped with the wiper 35, which will be described layer, to be ready for the next printing operation.

Referring back to FIG. 1, on a downstream side (the right side in FIG. 1) of the first conveyance unit 5 with respect to the paper sheet conveyance direction, there is disposed a second conveyance unit 12. The second conveyance unit 12 includes a second driving roller 13, a second driven roller 14, and a second conveyance belt 15 which is wound around the second driving roller 13 and the second driven roller 14, and the second driving roller 13 is driven to rotate in the clockwise direction, and thereby the sheet S held on the second conveyance belt 15 is conveyed in the arrow X direction.

The sheet S on which an ink image has been recorded at the recording portion 9 is sent to the second conveyance unit 12, and while the sheet S is passing through the second conveyance unit 12, ink that has been ejected on a surface of the sheet S is dried. Furthermore, below the second conveyance unit 12, there are disposed a maintenance unit 19 and a cap unit 90. For execution of a wiping operation by the wiper 35 described above, the first conveyance unit 5 descends, and the maintenance unit 19 moves to below the recording portion 9, wipes off the ink which has been forcibly discharged through the ink ejection ports 18*a* of the recording head 17 and the cleaning liquid 23 which has been supplied through the cleaning liquid supply ports 60*a*, and collects the wiped-off ink and cleaning liquid 23. For capping of the ink ejection surface F1 (see FIG. 3) of the recording head 17, the first conveyance unit 5 descends, and the cap unit 90 horizontally moves to below the recording portion 9 and then further moves upward to be attached to a lower surface of the recording head 17.

Furthermore, on a downstream side of the second conveyance unit 12 with respect to the sheet conveyance direction, there is provided a discharge roller pair 16 which discharges the sheet S on which an image has been recorded to an outside of the apparatus main body, and on a downstream side of the discharge roller pair 16, there is provided a discharge tray (not shown) on which the sheet S which has been discharged to the outside of the apparatus main body is loaded.

The maintenance unit 19 includes a plurality of wipers 35 (see FIG. 12) which are each movable along the ink ejection surface F1, a substantially rectangular carriage (not shown) on which the plurality of wipers 35 are secured, and a support frame (not shown) that supports the carriage. The carriage (not shown) is supported to be slidable in an arrow AA' direction with respect to the support frame (not shown).

Each wiper 35 is an elastic member (a member made of rubber such as, for example, EPDM) for wiping off the cleaning liquid 23 supplied through the cleaning liquid supply ports 60*a* (see FIG. 5) of a corresponding one of the recording heads 17. The wiper 35 is brought into pressure contact with a portion (herein, the inclined surface 62) of the cleaning liquid supply member 60 on an upstream side with respect to the cleaning liquid supply region R2 (see FIG. 4) in the wiping direction, and as the carriage (not shown) moves, the wiper 35 performs wiping with respect to the cleaning liquid supply surface F2 and the ink ejection surface F1 in a predetermined direction (an arrow A direction).

Next, a detailed description will be given of a structure of and around the cleaning liquid supply member 60, the subtank 71, and the main tank 81.

As illustrated in FIG. 6, at a predetermined position on the subtank 71, there is provided a first detection sensor 73 for detecting the cleaning liquid 23. The first detection sensor 73 has an electrode pair (not shown) to which voltage is applied and which is disposed inside the subtank 71. The first detection sensor 73 is capable of detecting presence/absence of the cleaning liquid 23 based on presence/absence of energization between the electrodes. When the first detection sensor 73 detects absence of liquid (absence of energization), from then until presence of liquid (presence of energization) is detected, the replenishment pump 82 continues to replenish the cleaning liquid 23 from the main tank 81 to the subtank 71. Thereby, a liquid surface (upper surface) of the cleaning liquid 23 in the subtank 71 is maintained at a substantially constant height.

At a lower portion of the main tank 81, there is provided a second detection sensor 83 for detecting the cleaning liquid 23. The second detection sensor 83 has an electrode pair (not shown) to which voltage is applied and which is disposed inside the main tank 81. The second detection sensor 83 is capable of detecting presence/absence of the cleaning liquid 23 based on presence/absence of energization between the electrodes. When the second detection sensor 83 detects absence of liquid, a notification is made on a display panel (not shown) of the inkjet recording apparatus 100 to the effect that the main tank 81 is empty. In response to this notification, a user or an operator replaces the main tank 81 with a new one, or replenishes the cleaning liquid 23 into the main tank 81.

The subtank 71 is disposed above the main tank 81 but below the cleaning liquid supply surface F2 of the recording head 17. Furthermore, the subtank 71 is provided with an atmosphere releasing port 71*a* for making the air pressure inside the subtank 71 equal to the atmospheric pressure. With this configuration, when communication between the inlet and the outlet of the supply pump 72 is opened with the supply pump 72 in an OFF state, negative pressure is applied to the cleaning liquid 23 at the cleaning liquid supply ports 60*a*.

As illustrated in FIG. 5, the plurality of cleaning liquid supply ports 60*a* are disposed at a predetermined distance from one another both in the wiping direction (the arrow A direction) and a head width direction (an arrow BB' direction, a direction perpendicular to the wiping direction).

Specifically, two or more cleaning liquid supply ports 60*a* are disposed along the head width direction to thereby form a supply-port row E1. As the supply-port row E1, a plurality of supply-port rows (in FIG. 5, four rows) are provided along the wiping direction.

Figure 7:
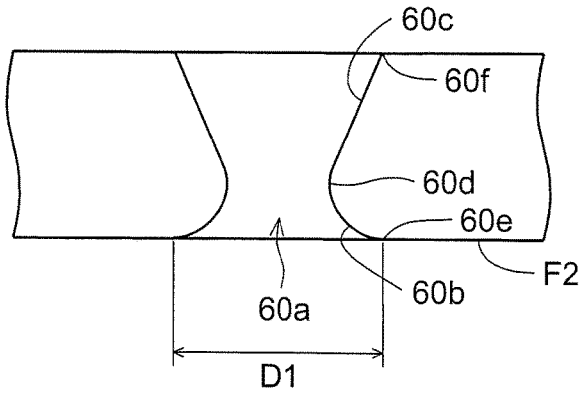
FIG. 7 is a diagram illustrating a structure of the cleaning liquid supply port of the cleaning liquid supply member of the recording head.

As illustrated in FIG. 7, at a portion of each cleaning liquid supply port 60*a* that intersects with the cleaning liquid supply surface F2 (that is, a lower end portion of the cleaning liquid supply port 60*a*), there is formed a chamfer portion 60*b* which is R-shaped in section. The chamfer portion 60*b* has a radius of curvature that is, for example, equal to or more than 50 μm but equal to or less than 100 μm. Here, the cleaning liquid supply port 60*a* is formed in a circular shape in plane view, and the chamfer portion 60*b* and an inclined surface 60*c*, which will be described later, are formed over the entire region in the circumferential direction of the cleaning liquid supply port 60*a*.

Above the chamfer portion 60*b*, the inclined surface 60*c* is formed to be wider upward. A small-diameter portion 60*d*, which has the smallest diameter in the cleaning liquid supply port 60*a*, has a diameter that is, for example, equal to or more than 30 μm but equal to or smaller than 100 μm. A lower end edge portion 60*e* (a lower end of the chamfer portion 60*b*) of the cleaning liquid supply port 60*a* has a diameter (=D1) that is larger than the diameter of the small-diameter portion 60*d* by about several tens of micrometers. An upper end edge portion 60*f* of the cleaning liquid supply port 60*a* has a diameter that is larger than the diameter of the small-diameter portion 60*d* by about several tens of micrometers. Here, the plurality of cleaning liquid supply ports 60*a* are disposed such that the lower end edge portions 60*e* thereof do not overlap one another in plan view. Furthermore, the plurality of cleaning liquid supply ports

60*a* are disposed such that the upper end edge portions 60*f* thereof do not overlap one another in plan view.

Figure 8:
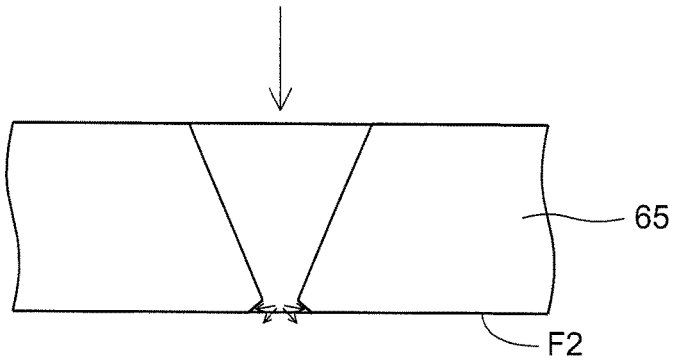
FIG. 8 is a diagram illustrating a state observed in course of forming a cleaning liquid supply port in the cleaning liquid supply member of the recording head by laser processing.

The cleaning liquid supply port 60*a* is formed by subjecting a polyimide film made of a polyimide resin to laser processing. Specifically, as illustrated in FIG. 8, for example, laser irradiation is performed at a first output power with respect to an upper surface (a surface on a side opposite to the cleaning liquid supply surface F2) of a sheet member 65 formed of a polyimide film having a thickness of 50 μm. In this way, the laser light penetrates the sheet member 65 while forming a hole that is wider upward, and thereby a through hole is formed. The laser irradiation is continued until the size of the through hole becomes a predetermined size. Here, the laser light having passed through the through hole is diffracted and curved in a surface direction of the cleaning liquid supply surface F2.

Figure 9:
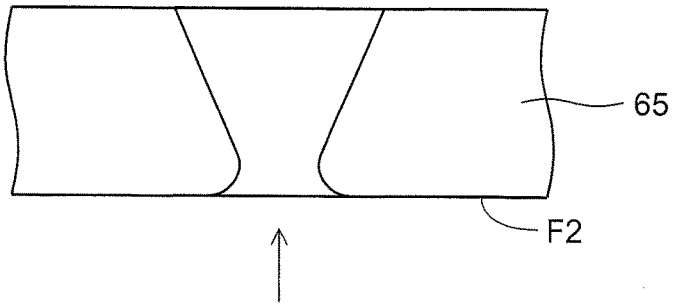
FIG. 9 is a diagram illustrating a state observed in course of forming a cleaning liquid supply port in the cleaning liquid supply member of the recording head by laser processing.

Then, as illustrated in FIG. 9, laser irradiation is performed from the cleaning-liquid-supply-surface-F2 side at a second output power, which is smaller than the first output power. The laser irradiation from the cleaning-liquid-supply-surface-F2 side is repeated several times with various spot diameters of the laser light to form the chamfer portion 60*b* in a predetermined R-shape. Here, the laser irradiation from the cleaning-liquid-supply-surface-F2 side may be performed only once if the chamfer portion 60*b* can be thereby formed in the predetermined R-shape.

In this way, as illustrated in FIG. 7, at the portion of the cleaning liquid supply port 60*a* that intersects the cleaning liquid supply surface F2, the chamfer portion 60*b* is formed to be R-shaped in section. Then, after the laser irradiation is completed, the sheet member 65 is subjected to permanganate treatment to thereby remove waste such as residual resin resulting from the laser irradiation.

To the upper surface of the sheet member 65, there may be attached a sheet metal (not shown) such as an SUS sheet. In this case, it is possible to reduce warp of the sheet member 65 made of a polyimide film. In the case where the sheet member 65 has a sheet metal attached to its upper surface, an opening larger than the upper end edge portion 60*f* of the cleaning liquid supply port 60*a* may be formed at a position corresponding to the cleaning liquid supply port 60*a* in the sheet metal by etching processing or the like before subjecting the sheet member 65 to the laser processing. Alternatively, in the case where the sheet member 65 has a sheet metal attached to its upper surface, laser irradiation may be performed on both the metal sheet and the sheet member 65, to thereby form through holes (the opening and the cleaning liquid supply port 60*a*) respectively in the metal sheet and the sheet member 65. In this case, too, it is possible to remove waste such as burnt remains and residual resin resulting from the laser irradiation by subjecting the sheet member 65 to permanganate treatment.

Next, a description will be given of a recovery operation for the recording head 17 performed using the maintenance unit 19 in the inkjet recording apparatus 100 of the present embodiment. The recovery operation for the recording head 17 described below is executed by controlling, based on a control signal from the control portion 110 (see FIG. 1), operations of the recording head 17, the maintenance unit 19, the supply pump 72, and so on.

Figure 10:
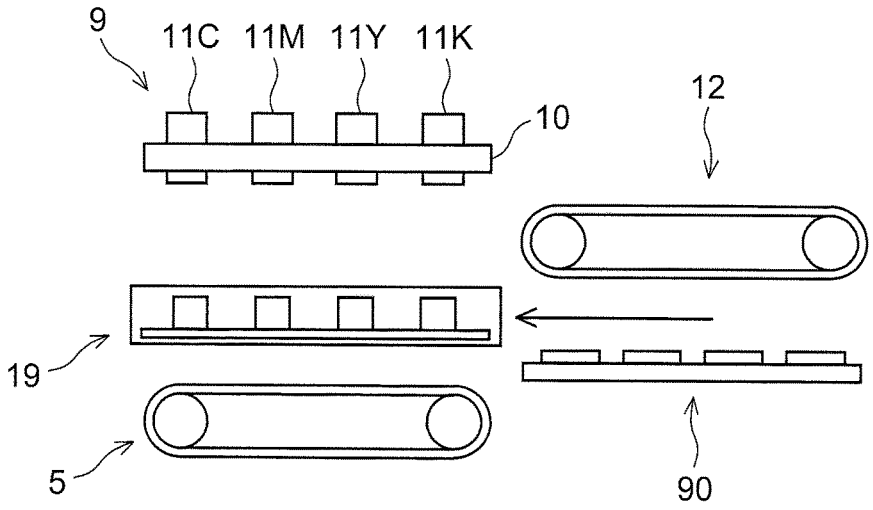
FIG. 10 is a diagram illustrating a state where a maintenance unit is disposed below the recording portion.
Figure 11:
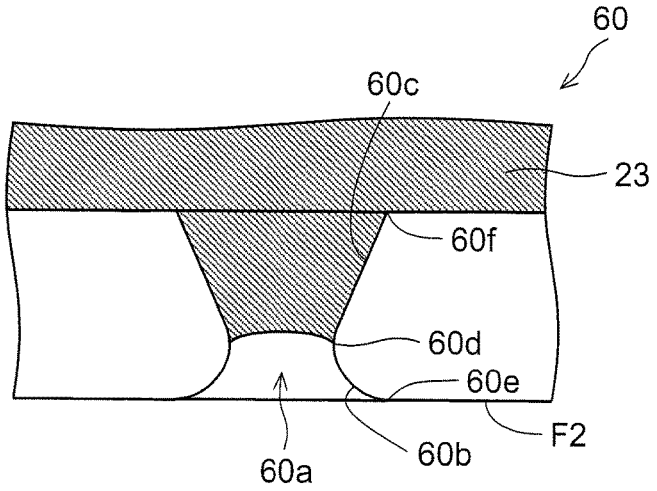
FIG. 11 is a diagram illustrating a structure of a cleaning liquid supply port of the cleaning liquid supply member of the recording head, in a state where a liquid surface of a cleaning liquid is formed at a small-diameter portion of the cleaning liquid supply port.

In a case of performing the recovery operation for the recording head 17, first, as shown in FIG. 10, the control portion 110 (see FIG. 1) causes the first conveyance unit 5 positioned below the recording portion 9 to descend. Then, the control portion 110 causes the maintenance unit 19 disposed below the second conveyance unit 12 to horizontally move to a position between the recording portion 9 and the first conveyance unit 5. In this state, the wiper 35 (see FIG. 12) of the maintenance unit 19 is disposed below the ink ejection surface F1 and the cleaning liquid supply surface F2 (see FIG. 3) of the recording head 17. At this time, the supply pump 72 is in an off state, and as shown in FIG. 11, a liquid surface (lower surface) of the cleaning liquid 23 is formed at the small-diameter portion 60*d* of the cleaning liquid supply port 60*a*. Here, by adjusting the position of the subtank 71 in height with respect to the cleaning liquid supply surface F2, the liquid surface of the cleaning liquid 23 can be easily formed at the small-diameter portion 60*d*.

Figure 12:
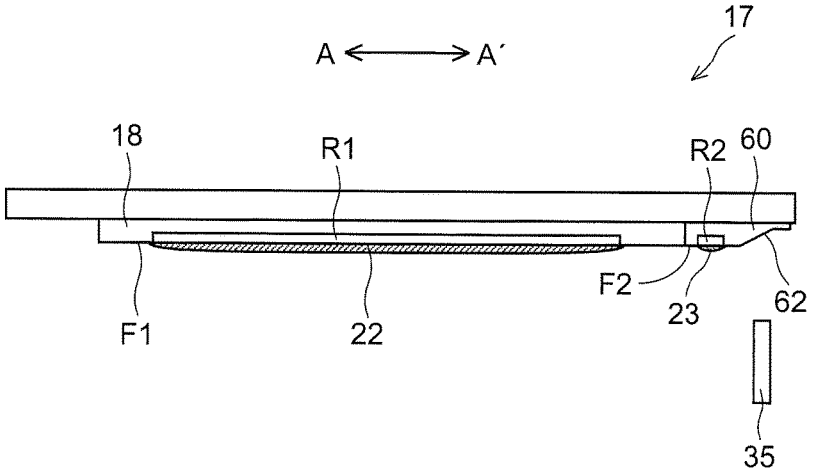
FIG. 12 is a diagram illustrating a state where a wiper is disposed below the recording head.
Figure 13:
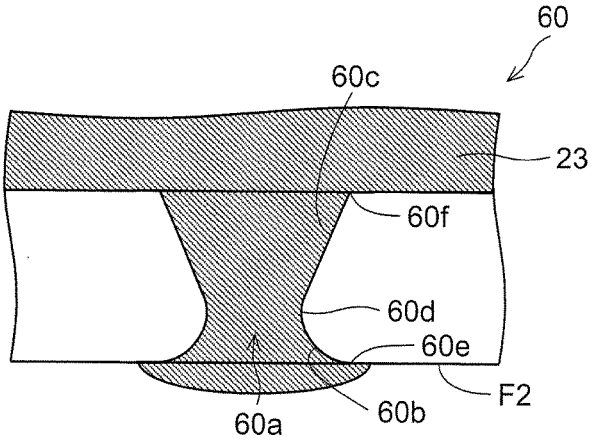
FIG. 13 is a diagram illustrating a structure of a cleaning liquid supply port of the cleaning liquid supply member of the recording head, in a state where the cleaning liquid has been supplied through the cleaning liquid supply port.

Cleaning Liquid Supply Operation: Prior to a wiping operation (a wipe-off operation, which will be described later), the supply pump 72 (see FIG. 6) is driven (turned on) by the control portion 110 (see FIG. 1), and the cleaning liquid 23 is supplied to the recording head 17 as shown in FIG. 12; then, after a predetermined time is elapsed, the supply pump 72 is stopped (turned off) and the communication between the inlet and the outlet of the supply pump 72 is closed. At this time, the cleaning liquid 23 is brought into the state illustrated in FIG. 13. That is, the cleaning liquid 23 is brought into a state where it projects from the cleaning liquid supply port 60*a* to form a convex shape due to surface tension thereof.

Ink Extrusion Operation: Furthermore, prior to the wiping operation (the wipe-off operation which will be described later), as shown in FIG. 12, the control portion 110 (see FIG. 1) causes ink 22 to be supplied to the recording head 17. The ink 22 thus supplied is forcibly extruded (purged) through the ink ejection ports 18*a*. As a result of this purge operation, thickened ink, foreign substances, and air bubbles in the ink ejection ports 18*a* are discharged from the ink ejection ports 18*a*. At this time, the ink 22 thus purged is extruded onto the ink ejection surface F1 along a shape of the ink ejection region R1 where the ink ejection ports 18*a* exist. In the figure, the ink (the purged ink) 22 is hatched for easier understanding.

Figure 14:
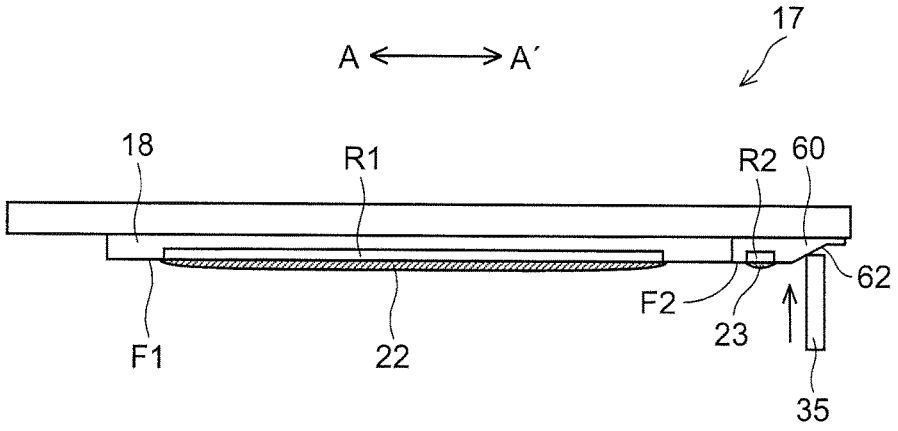
FIG. 14 is a diagram illustrating a state where the wiper has been caused to ascend from the state shown in FIG. 12 into pressure contact with the cleaning liquid supply member.

Wipe-off Operation: As shown in FIG. 14, the control portion 110 causes the wiper 35 to ascend to be brought into contact under a predetermined pressure with the inclined surface 62 of the cleaning liquid supply member 60 of the recording head 17. At this time, the wiper 35 is ascended so as for an upper surface of the wiper 35 to be located about 1 mm higher than ink ejection surface F1 and the cleaning liquid supply surface F2. As a result, an intrusion amount (overlap amount) of the wiper 35 with respect to the ink ejection surface F2 and the cleaning liquid supply surface F2 becomes about 1 mm. At the time point when the wiper 35 is ascended, the wiper 35 does not need to be in pressure contact with the inclined surface 62 yet. That is, the wiper 35 may be ascended at a position more to the right than in FIG. 14.

Figure 15:
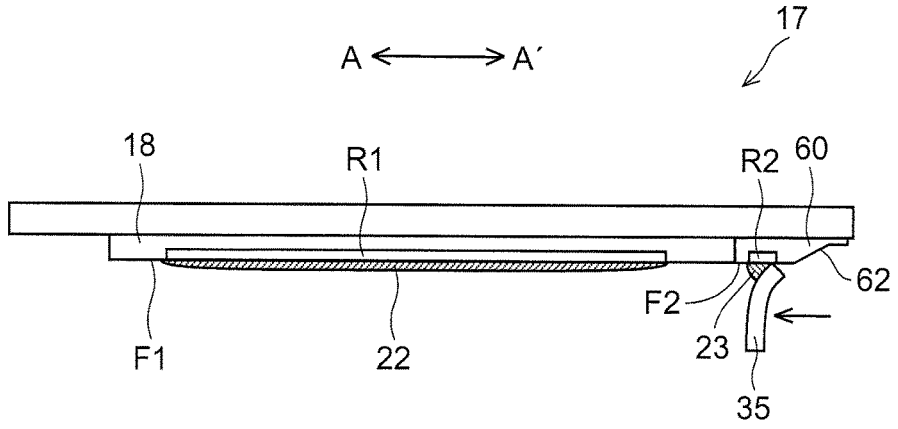
FIG. 15 is a diagram illustrating a state where the wiper, while being in pressure contact with the cleaning liquid supply member, has been caused to move in an arrow A direction from the state illustrated in FIG. 14.
Figure 16:
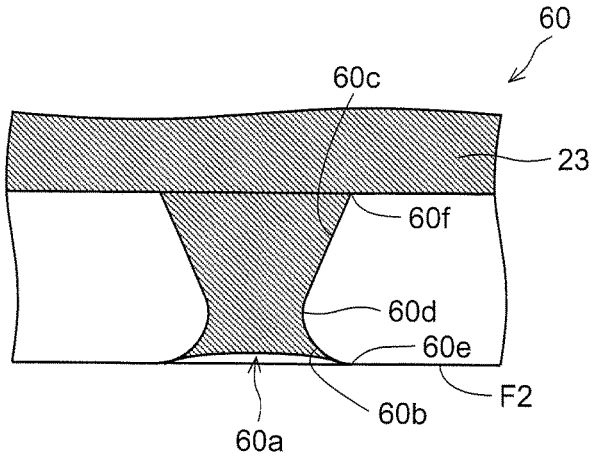
FIG. 16 is a diagram illustrating a structure of a cleaning liquid supply port of the cleaning liquid supply member of the recording head, illustrating a state after the cleaning liquid supply surface is wiped by the wiper.

From a state where a leading end of the wiper 35 is in pressure contact with the inclined surface 62 of the cleaning liquid supply member 60, the control portion 110 causes the wiper 35 to move, as illustrated in FIG. 15, in a direction toward the ink ejection region R1 (the arrow A direction) along the cleaning liquid supply surface F2. Thereby, the wiper 35 scoops up the cleaning liquid in the state of projecting from the cleaning liquid supply ports 60*a* in the convex shape (at this time, part of the cleaning liquid 23 existing inside the cleaning liquid supply ports 60*a* moves toward the wiper 35 side), and thus moves toward the ink ejection region R1 while holding the cleaning liquid 23. At this time, the cleaning liquid 23 in the cleaning liquid supply member 60 is in the state illustrated in FIG. 16. That is, a meniscus of the cleaning liquid 23 is formed at the lower end edge portion 60*e* of the cleaning liquid supply port 60*a*.

After passage of the leading end of the wiper 35 over the cleaning liquid supply region R2, the supply pump 72 is switched to the state where the communication between the inlet and the outlet thereof is opened. As a result, a negative pressure is applied to the cleaning liquid 23 in the cleaning liquid supply port 60*a*, and the cleaning liquid 23 is brought back into the state illustrated in FIG. 11.

Figure 17:
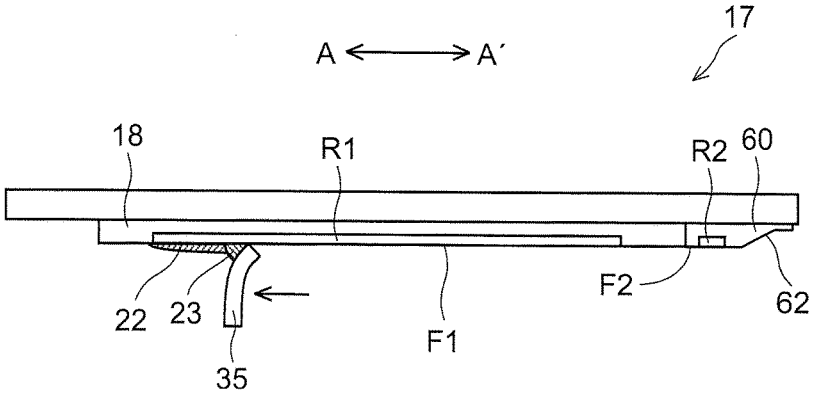
FIG. 17 is a diagram illustrating a state where the wiper has been caused to move further in the arrow A direction from the state in FIG. 15.

Then, as shown in FIG. 17, while maintaining the state of holding the cleaning liquid 23, the wiper 35 moves leftward (in the arrow A direction) along the ink ejection surface F1. At this time, the cleaning liquid 23 and the ink (purged ink) 22 dissolve ink droplets (waste ink) that have adhered to and solidified on the ink ejection surface F1, and the ink droplets (waste ink) thus dissolved are wiped off by the wiper 35. Then, the wiper 35 moves further leftward (in the arrow A direction) and, upon reaching a position opposite from the cleaning liquid supply region R2 with respect to the ink ejection region R1, the leftward direction of the wiper 35 is stopped. Here, the cleaning liquid 23 and the waste ink that have been wiped off by the wiper 35 are collected into a cleaning liquid collection tray (not shown) which is provided in the maintenance unit 19.

Figure 18:
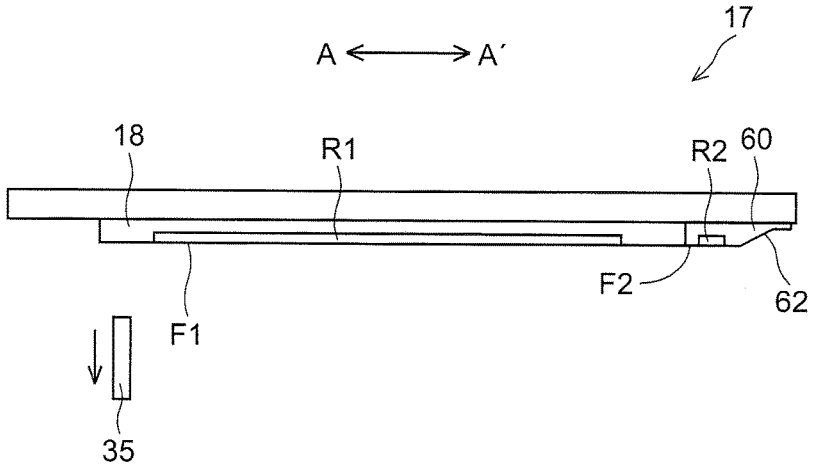
FIG. 18 is a diagram illustrating a state where, after moving further in the arrow A direction from the state in FIG. 17, the wiper has been caused to descend to a position apart from the ink ejection surface.

Separation Operation: After the execution of the wipe-off operation, as shown in FIG. 18, the control portion 110 causes the wiper 35 to descend to a position apart from the ink ejection surface F1.

Finally, the control portion 110 causes the maintenance unit 19, which is disposed between the recording portion 9 and the first conveyance unit 5, to horizontally move to be disposed below the second conveyance unit 12, and causes the first conveyance unit 5 to ascend to a predetermined position. In this manner, the recovery operation for the recording head 17 is completed.

In this embodiment, as described above, on an upstream side in the wiping direction with respect to the ink ejection ports 18*a*, the plurality of cleaning liquid supply ports 60*a* for supplying the cleaning liquid 23 are provided. With this configuration, after the cleaning liquid 23 is supplied through the cleaning liquid supply ports 60*a*, the wiper 35 is caused to move, from a position on an upstream side of the cleaning liquid supply ports 60*a* in the wiping direction, along the ink ejection surface F1, and in this manner it is possible to have the ink ejection surface F1 wiped by using the wiper 35 while the wiper 35 holding the cleaning liquid 23. Thereby, it is possible to make the ink ejection surface F1 clean.

Furthermore, at a portion of the cleaning liquid supply port 60*a* that intersects the cleaning liquid supply surface F2, the chamfer portion 60*b* is formed to be R-shaped in section. With this configuration, it is possible to reduce stress the leading end of the wiper 35 receives from the cleaning liquid supply port 60*a* when the wiper 35 passes over the cleaning liquid supply port 60*a*, and thus to reduce risk of damage to the leading end of the wiper 35.

Furthermore, as described above, the chamfer portion 60*b* is formed over the entire region in the circumferential direction of the cleaning liquid supply port 60*a*. Thereby, it is possible to further reduce the risk of damage to the leading end of the wiper 35.

Furthermore, as described above, the chamfer portion 60*b* has a radius of curvature that is equal to or more than 50 μm but equal to or less than 100 μm. Thereby, it is possible to sufficiently reduce the risk of damage to the leading end of the wiper 35.

Furthermore, as described above, the plurality of cleaning liquid supply ports 60*a* are provided in the cleaning liquid supply region R2 disposed on an upstream side in the wiping direction with respect to the ink ejection region R1, where the plurality of ink ejection ports 18*a* are disposed. With this configuration, it is possible to form a passage for ink and a passage for cleaning liquid separately (apart from each other) in the recording head 17, and thus to prevent the structure of the recording head 17 from becoming too complicated.

Furthermore, as described above, the recording head 17 includes the head portion 18 where the plurality of ink ejection ports 18*a* are formed and the cleaning liquid supply member 60 where the plurality of cleaning liquid supply ports 60*a* are formed. With this configuration, it is possible to form the cleaning liquid supply ports 60*a* easier than in a case of forming them in the head portion 18.

Furthermore, as described above, the cleaning liquid supply surface F2 of the cleaning liquid supply member 60 is formed of a polyimide resin. This makes it easy to form the chamfer portion 60*b*, which is R-shaped in section, at a portion of the cleaning liquid supply port 60*a* that intersects the cleaning liquid supply surface F2 by laser processing.

Figure 19:
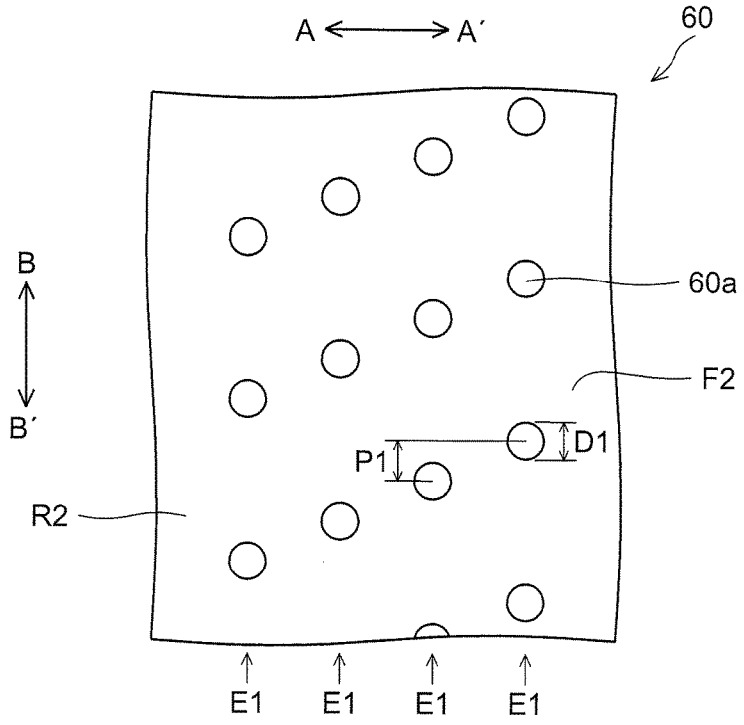
FIG. 19 is a diagram illustrating, as seen from below, cleaning liquid supply ports of a cleaning liquid supply member of a recording head according to a second embodiment of the present disclosure.

Second Embodiment: In a recording head 17 according to a second embodiment of the present disclosure, as illustrated in FIG. 19, a plurality of cleaning liquid supply ports 60*a* are disposed not to overlap each other in a wiping direction (an arrow A direction).

Specifically, supply-port rows E1 each including two or more cleaning liquid supply ports 60*a* disposed along a head width direction (an arrow BB' direction) are disposed such that adjacent ones thereof are displaced with respect to each other in a head width direction by a predetermined distance (a pitch P1). Furthermore, the pitch P1 for the cleaning liquid supply ports 60*a* in the head width direction is set to be larger than an opening diameter D1 of the cleaning liquid supply port 60*a*.

The plurality of cleaning liquid supply ports 60*a* are disposed such that lower end edge portions 60*e* (see FIG. 7) thereof do not overlap one another in the wiping direction and such that upper end edge portions 60*f* (see FIG. 7) thereof do not overlap one another in plan view.

Other structures, the method for forming the cleaning liquid supply port 60*a*, and the recovery operation for the recording head 17 of the second embodiments are similar to those of the first embodiment discussed above.

In the present embodiment, as described above, the plurality of cleaning liquid supply ports 60*a* are disposed such that the lower end edge portions 60*e* (see FIG. 7) thereof do not overlap one another in the wiping direction. With this configuration, no portion of a leading end of the wiper 35 rubs against the two or more cleaning liquid supply ports 60*a* in one wiping operation, and thus it is possible to further reduce the risk of damage to the leading end of the wiper 35.

Furthermore, as described above, in the case where the plurality of cleaning liquid supply ports 60*a* are disposed such that the lower end edge portions 60*e* thereof do not overlap one another in the wiping direction, a plurality of supply-port rows E1 are provided along the wiping direction. With this configuration, it is possible to form the cleaning liquid supply ports 60*a* to be closer to one another (at a smaller pitch) in the head width direction than in a case of providing just one supply-port row E1. As a result, it is possible to secure a necessary amount of the cleaning liquid 23 with ease. Here, as described above, in the case where the plurality of cleaning liquid supply ports 60*a* are disposed such that the lower end edge portions 60*e* thereof do not overlap one another in the wiping direction, when the inclined surface 60*c* (see FIG. 7) which is wider upward is provided and just one supply-port row E1 is provided, it is difficult to form adjacent cleaning liquid support ports 60*a* to be close to each other in the head width direction in order to avoid overlapping of the upper end edge portions 60*f* of adjacent cleaning liquid support ports 60*a*.

Other advantages of the second embodiment are similar to those of the first embodiment discussed further above.

It should be understood that the embodiments disclosed herein are merely illustrative in all respects, and should not be interpreted restrictively. The range of the present disclosure is shown not by the above descriptions of the embodiments but by the scope of claims for patent, and it is intended that all modifications within the meaning and range equivalent to the scope of claims for patent are included.

For example, in the embodiments discussed above, an example has been dealt with in which the cleaning liquid supply surface F2 is formed of a polyimide resin, but this is not meant to limit the present disclosure, and the cleaning liquid supply surface F2 may be formed of a metal such as SUS, or a resin other than the polyimide resin.

Furthermore, in the embodiments discussed above, an example has been dealt with in which the cleaning liquid supply ports 60*a* are formed by subjecting the sheet member 65 formed of a polyimide film to laser processing, but this is not meant to limit the present disclosure. Instead, the cleaning liquid supply ports 60*a* may be formed by subjecting the sheet member 65 to either or both of etching processing and punching processing depending on the material of the sheet member 65. Or, the cleaning liquid supply ports 60*a* may be formed by subjecting a resin to injection molding by using a mold.

Figure 20:
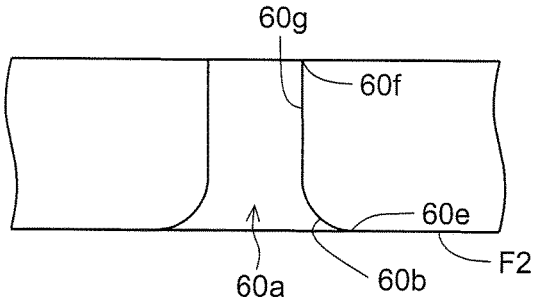
FIG. 20 is a diagram illustrating a structure of a cleaning liquid supply port formed in a cleaning liquid supply member of a recording head according to a first modified example of the present disclosure.

Moreover, in the embodiments discussed above, an example has been dealt with in which, above the chamfer portion 60*b*, the inclined surface 60*c*, which is wider upward, is provided, but this is not meant to limit the present disclosure. For example, as in a recording head 17 of a first modified example of the present disclosure illustrated in FIG. 20, a portion of the cleaning liquid supply port 60*a* above a chamfer portion 60*b* may be formed of a cylinder surface 60*g* extending in a direction perpendicular to a cleaning liquid supply surface F2.

Furthermore, in the embodiments discussed above, an example has been dealt with in which the plurality of supply-port rows E1 are arranged in a wiping direction, but this is not meant to limit the present disclosure, and only one supply-port row E1 may be provided along the wiping direction.

Figure 21:
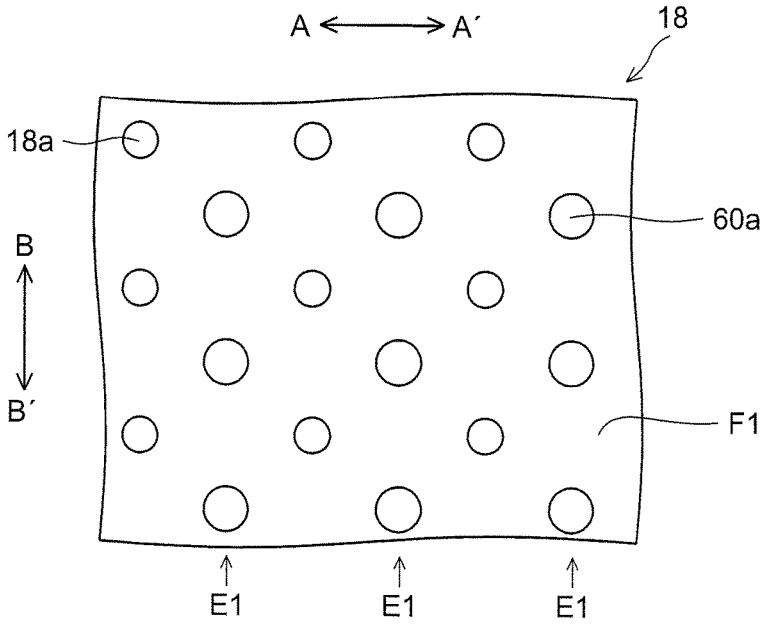
FIG. 21 is a diagram illustrating, as seen from below, cleaning liquid supply ports and cleaning liquid supply ports in a cleaning liquid supply member of a recording head of a second modified example of the present disclosure.

Furthermore, in the embodiments discussed above, an example has been dealt with in which the cleaning liquid supply member 60 where the cleaning liquid supply ports 60*a* are disposed is provided as a body different from the head portion 18, but this is not meant to limit the present disclosure. Instead, without providing the cleaning liquid supply member 60, the cleaning liquid supply ports 60*a* may be formed in the head portion 18. At this time, for example, as in a recording head 17 of a second modified example of the present disclosure illustrated in FIG. 21, cleaning liquid supply ports 60*a* may be disposed adjacent to ink ejection ports 18*a* (for example, such that the ink ejection ports 18*a* and supply-port rows E1 are alternately disposed in an arrow AA' direction).

Furthermore, in the embodiments discussed above, an example has been dealt with in which the cleaning liquid supply port 60*a* is formed in a circular shape in plan view, but the cleaning liquid supply port 60*a* does not particularly need to be circular shaped in plan view.

Furthermore, in the embodiments discussed above, an example has been dealt with in which the recovery operation for the recording head 17 is performed using the cleaning liquid 23 and the ink (purged ink) 22, but instead, the recovery operation for the recording head 17 may be performed using the cleaning liquid 23 alone. That is, the ink extrusion operation does not need to be performed.

It should be understood that configurations obtained by appropriately combining the configurations of the foregoing embodiments and modified examples are also included in the scope of the present disclosure.

What is claimed is:

1. A recording head comprising an ink ejection surface where a plurality of ink ejection ports for ejecting ink onto a recording medium are disposed, wherein a plurality of cleaning liquid supply ports for supplying a cleaning liquid are disposed on an upstream side with respect to the ink ejection ports in a wiping direction which is a direction in which a wiper wipes the ink ejection surface, and the cleaning liquid supply ports each have a chamfer portion formed at a portion thereof that intersects a surface to be wiped by the wiper, the chamfer portion being R-shaped in section.

2. The recording head according to claim 1, wherein the cleaning liquid supply ports are each circular-shaped in plan view, and the chamfer portion is formed over an entire region in a circumferential direction of each of the cleaning liquid supply ports.

3. The recording head according to claim 1, wherein the chamfer portion has a radius of curvature that is equal to or more than 50 μm but equal to or less than 100 μm.

4. The recording head according to claim 1, wherein the ink ejection surface includes an ink ejection region where the plurality of ink ejection ports are disposed, and the plurality of cleaning liquid supply ports are disposed in a cleaning liquid supply region which is disposed on an upstream side with respect to the ink ejection region in the wiping direction.

5. The recording head according to claim 4, wherein the recording head includes an ink ejection head portion having the ink ejection surface, and a cleaning liquid supply head portion having a cleaning liquid supply surface where the cleaning liquid supply region is disposed.

6. The recording head according to claim 5, wherein the cleaning liquid supply surface of the cleaning liquid supply head portion is formed of a polyimide resin.

7. An inkjet recording apparatus comprising:

the recording head according to claim 1; and the wiper which wipes the ink ejection surface.

* * * * *